US010931035B2

(12) United States Patent
Song et al.

(10) Patent No.: US 10,931,035 B2
(45) Date of Patent: Feb. 23, 2021

(54) PARASITIC ELEMENTS FOR ISOLATING ORTHOGONAL SIGNAL PATHS AND GENERATING ADDITIONAL RESONANCE IN A DUAL-POLARIZED ANTENNA

(71) Applicant: QUINTEL CAYMAN LIMITED, George Town (KY)

(72) Inventors: Peter Chun Teck Song, San Jose, CA (US); David Edwin Barker, Stockport (GB)

(73) Assignee: Quintel Cayman Limited, Grand Cayman (KY)

( * ) Notice: Subject to any disclaimer, the term of this patent is extended or adjusted under 35 U.S.C. 154(b) by 0 days.

(21) Appl. No.: 16/526,476

(22) Filed: Jul. 30, 2019

(65) Prior Publication Data

US 2020/0044365 A1 Feb. 6, 2020

Related U.S. Application Data

(60) Provisional application No. 62/714,421, filed on Aug. 3, 2018.

(51) Int. Cl.

| | |
|---|---|
| ***H01Q 25/00*** | (2006.01) |
| ***H01Q 5/392*** | (2015.01) |
| ***H01Q 5/49*** | (2015.01) |

(52) U.S. Cl.

CPC ..... *H01Q 25/001* (2013.01); *H01Q 5/392* (2015.01); *H01Q 5/49* (2015.01)

(58) Field of Classification Search

CPC ..... H01Q 25/001; H01Q 5/392; H01Q 5/49; H01Q 5/48; H01Q 1/523; H01Q 21/26

See application file for complete search history.

(56) References Cited

U.S. PATENT DOCUMENTS

| | | | | |
|---|---|---|---|---|
| 2010/0171675 | A1* | 7/2010 | Borja | H01Q 9/0414 343/798 |
| 2015/0214617 | A1* | 7/2015 | Shang | H01Q 1/52 343/722 |
| 2018/0323513 | A1 | 11/2018 | Varnoosfaderani et al. | |
| 2019/0140364 | A1 | 5/2019 | Mirmozafari et al. | |

OTHER PUBLICATIONS

International Search Report and Written Opinion mailed in corresponding PCT Application No. PCT/US2019/044149 dated Oct. 25, 2019, 13 pages.

* cited by examiner

*Primary Examiner* — Raymond R Chai

(74) *Attorney, Agent, or Firm* — Tong, Rea, Bentley & Kim, LLC

(57) ABSTRACT

An antenna system may include a dual-polarized antenna element having a first dipole and a second dipole in a same lateral plane, the first dipole having a first and a second dipole arm, the second dipole comprising a third and a fourth dipole arm, the first dipole being co-located with the second dipole, and the first dipole having an orthogonal polarization to the second dipole. The antenna system may further include parasitic elements, each comprising at least two branches, the at least two branches including a first branch and a second branch oriented at an angle and forming an apex. A first branch of a first parasitic element may be positioned at a first coupling distance parallel to the first dipole arm of the first dipole, and a second branch may be positioned at a second coupling distance parallel to the third dipole arm of the second dipole.

23 Claims, 5 Drawing Sheets

PARASITIC ELEMENTS FOR ISOLATING ORTHOGONAL SIGNAL PATHS AND GENERATING ADDITIONAL RESONANCE IN A DUAL-POLARIZED ANTENNA

CROSS REFERENCE TO RELATED APPLICATIONS

This application claims priority to U.S. Provisional Patent Application Ser. No. 62/714,421, filed Aug. 3, 2018, which is herein incorporated by reference in its entirety.

FIELD OF THE DISCLOSURE

The present disclosure relates generally to communication antenna systems, and relates more specifically to dual-polarized antenna elements and antenna arrays with parasitic elements having improved port-to-port isolation and broadened impedance bandwidth.

BACKGROUND

Additional spectrum bands have been released in recent years, and cellular operators have been deploying new radio access technologies to meet subscriber traffic demands. An antenna system at a base station site may support multiple bands operating over a very large bandwidth (e.g. 617-960 MHz, 1427-2690 MHz). The antenna system may also be preferred to have desired radiation properties and diversity performance, with good port-to-port isolation. Dual-polarized antenna elements which have two independent RF ports on the same antenna structure are widely used in mobile communications since the two orthogonal polarized elements are co-located without space penalties and also provide a means for polarization diversity to the radio.

SUMMARY

In one example, the present disclosure describes an antenna system that includes at least one dual-polarized antenna element, the at least one dual-polarized antenna element comprising a first dipole and a second dipole which are in a same lateral plane, the first dipole comprising a first dipole arm and a second dipole arm, the second dipole comprising a third dipole arm and a fourth dipole arm, the first dipole being co-located with the second dipole, and the first dipole having an orthogonal polarization to the second dipole. The antenna system may further include a plurality of parasitic elements, each parasitic element comprising at least two branches, the at least two branches including a first branch and a second branch oriented at an angle and forming an apex. In one example, a first branch of a first parasitic element of the plurality of parasitic elements is positioned at a first coupling distance and parallel to the first dipole arm of the first dipole. In addition, a second branch of the first parasitic element may be positioned at a second coupling distance and parallel to the third dipole arm of the second dipole.

In one example, the present disclosure also describes a parasitic element comprising at least two branches, the at least two branches including a first branch and a second branch oriented at an angle and forming an apex. In one example, the parasitic element is for deployment as one of a plurality of parasitic elements for at least one dual-polarized antenna element comprising a first dipole and a second dipole which are in a same lateral plane, the first dipole comprising a first dipole arm and a second dipole arm, the second dipole comprising a third dipole arm and a fourth dipole arm, the first dipole being co-located with the second dipole, and the first dipole being orthogonally polarized to the second dipole. In one example, the first branch of the parasitic element is for positioning at a first coupling distance and parallel to the first dipole arm of the first dipole and the second branch of the parasitic element is for positioning at a second coupling distance and parallel to the third dipole arm of the second dipole.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate identical elements that are common to the figures.

DETAILED DESCRIPTION

Examples of the present disclosure describe a technique to improve the port-to-port isolation and broaden the impedance bandwidth of a dual-polarized antenna element, such as a cross-dipole antenna element. A parasitic element is added between the radiating elements (e.g., the driven dipoles) of a dual-polarized antenna element to provide an orthogonal radio frequency (RF) current cancellation. This results in an improved isolation across a large bandwidth of the dual-polarized antenna element. Concurrently the parasitic element also generates an additional resonance mode, which couples into the main radiating elements to broaden the operating bandwidth.

As used herein, the terms "antenna" and "antenna array" may be used interchangeably. For consistency, and unless otherwise specifically noted, with respect to any of the antenna arrays depicted the real-world horizon is indicated as left-to-right/right-to-left on the page, and the up/vertical direction is in a direction from the bottom of the page to the top of the page consistent with the text/numerals of the figure.

It should also be noted that although the terms, "first," "second," "third," etc., may be used herein, these terms are intended as labels only. Thus, the use of a term such as "third" in one example does not necessarily imply that the example must in every case include a "first" and/or a "second" of a similar item. In other words, the use of the terms "first," "second," "third," and "fourth," do not imply a particular number of those items corresponding to those numerical values. In addition, the use of the term "third" for example, does not imply a specific sequence or temporal relationship with respect to a "first" and/or a "second" of a particular type of item, unless otherwise indicated.

Additional spectrum bands have been released in recent years, and cellular operators have been deploying new radio access technologies to meet subscriber traffic demands. An antenna system at a base station site may support multiple bands operating over a very large bandwidth (e.g. 617-960 MHz, 1427-2690 MHz). The antenna system may also be preferred to have desired radiation properties and diversity performance, with good port-to-port isolation. Dual-polarized antenna elements which have two independent RF ports on the same antenna structure are widely used in mobile communications since the two orthogonal polarized elements are co-located without space penalties and also provide a means for polarization diversity to the radio.

Figure 1:
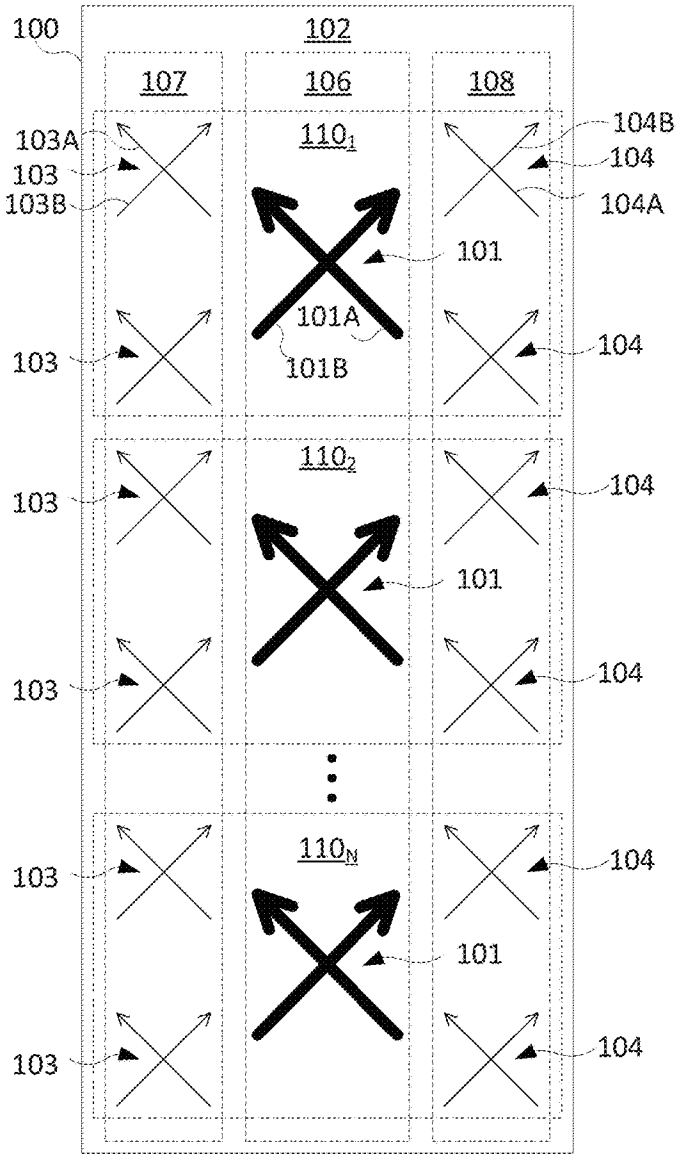
FIG. 1 depicts a base station antenna with a triple array configuration.

FIG. 1 depicts a triple array configuration with a base station antenna 100 comprising a series of N unit cells $\mathbf{110}_1$ to $\mathbf{110}_N$, which are configured to make up three dual-polarized antenna arrays 106, 107 and 108 positioned over a reflector 102. The first dual-polarized antenna array 106 is designed for operation in a LB range of RF frequencies, while the second dual-polarized antenna array 107 and third dual-polarized antenna array 108 are designed for operation in a HB range of RF frequencies. Each unit cell comprises a larger LB dual-polarized antenna element 101 for the LB dual-polarized antenna array 106, two HB dual-polarized antenna elements (each element 103) for the first HB dual-polarized antenna array 107, and two HB dual-polarized antenna elements (each element 104) for the second HB dual-polarized antenna array 108. The vertical distance between HB dual-polarized antenna elements, or pitch, is typically half of the pitch of the LB dual-polarized antenna elements 101. In this triple dual-polarized column antenna array, the LB dual-polarized antenna array 106 is typically positioned in the center of the reflector 102. This configuration is also commonly referred to as a "side-by-side" base station antenna configuration.

The LB dual-polarized antenna element 101 may comprise a radiating element 101A such as a dipole which has a slant polarization at +45 degrees and an orthogonally polarized radiating element 101B which has a slant polarization at −45 degrees. Each of the LB dual-polarized antenna elements $\mathbf{110}_1$-$\mathbf{110}_N$ are distributed along the length of the reflector 102 at a prescribed pitch that is tuned to optimize for directivity, elevation radiation main beam tilt range and elevation radiation pattern sidelobe performance. Each dual-polarized antenna element 103 of the first HB dual-polarized antenna array 107 also comprises +45 degree polarized and −45 degree polarized radiating elements 103A and 103B respectively. Each dual-polarized antenna element 104 of the second HB dual-polarized antenna array 108 also comprises +45 degree polarized and −45 degree polarized radiating elements 104A and 104B, respectively. Due to this arrangement, the reflector width of the antenna may be broadened to accommodate all these elements. However, the proximity of the elements may still create additional mutual coupling effects causing corruption to radiation patterns, poorer port-to-port isolation, and reduced impedance bandwidth.

Figure 2A:
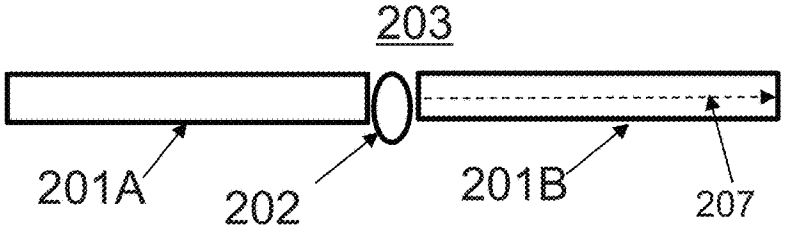
FIGS. 2A-2D illustrate examples of dipole antennas, or antenna elements.
Figure 2B:
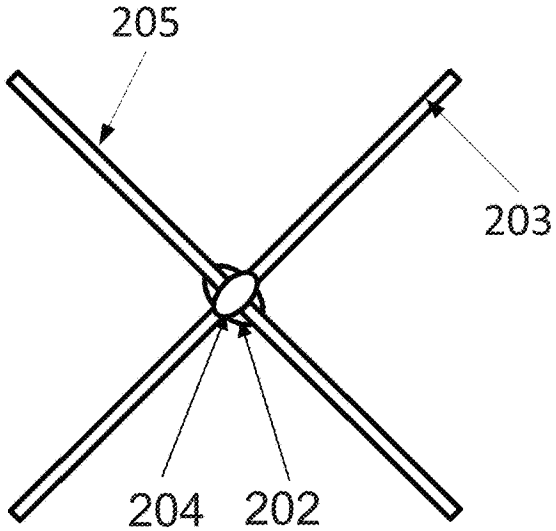

A first dipole 203 (or "dipole antenna") as shown in FIG. 2A may comprise a pair of quarter wave long conductors 201A and 201B connected via a feed port 202 to drive radio frequency (RF) power into the dipole 203 for radiation. This arrangement gives the resonating dipole 203 an approximate length of a half wavelength ($\lambda/2$) of the operating frequency $F_1$. To create a dual-polarized or diversity pair of dipoles as shown in FIG. 2B, a second dipole 205 with feed port 204 is placed orthogonally to the first dipole 203 where both feed ports 202 and 204 for the first and second dipoles 203 and 205 are co-located.

Figure 2C:
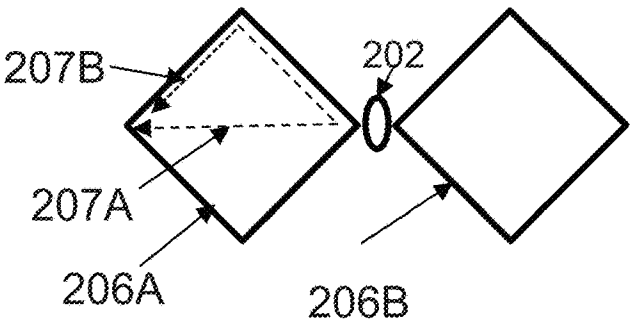
Figure 2D:
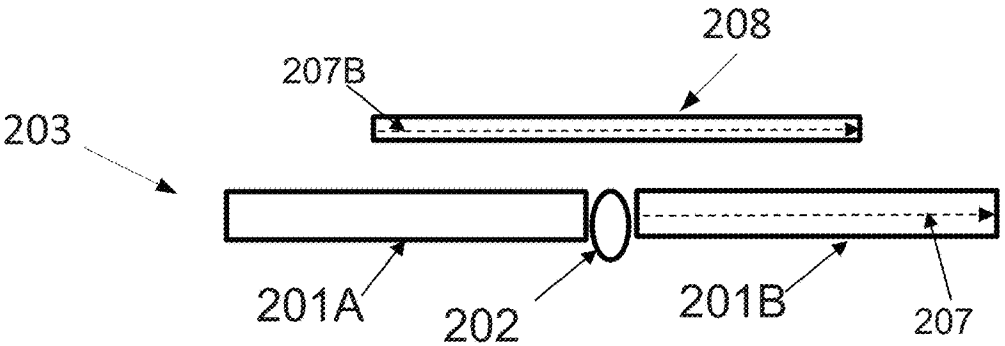

Additionally, each dipole 203 and 205 only resonates at a single frequency $F_1$ due to its physical length generating a single current path, e.g., current path 207 as shown in FIG. 2A. Several techniques are available to enhance the bandwidth of a single dipole, such as increasing the size of the conducting area into a pair of squares radiators 206A and 206B as shown in FIG. 2C or by using parasitic elements 208 as shown in FIG. 2D to generate additional resonances in both cases. The antenna shown in FIG. 2C is also known as the "Bow-Tie" antenna and has two current paths which are excited. First path 207A has the shortest path resulting in resonance frequency $F_1$, and second path 207B along the edge of the conductor resulting in a second resonance frequency $F_2$. In FIG. 2D, a parasitic element 208 with a different conductor length accounts for a second resonance frequency $F_2$ (via current path 207B) when placed in closed proximity to dipole 203. The result of the parasitically coupled second resonance is an increase in the bandwidth of the dipole/radiating element.

Dual-polarized antenna elements can be designed for optimal (i.e., low to zero) radiated cross-polar components or for optimal (i.e., large) bandwidth. These two design goals are often in conflict with one another. A wideband dual-polarized antenna element using bow-tie dipoles may generate larger radiated cross-polar components, whereas a dual-polarized antenna element using dipoles may provide small radiated cross-polar components but may remain relatively narrowband. This is because the physical dimensions of the feeds and dipoles/radiating elements do not scale with frequency to provide consistent optimal radiated behaviour.

In order to achieve good port-to-port isolation and improved cross polarization level while maintaining wider bandwidths, antenna designs may use aperture-coupled feeds or a feed capacitive coupling method to minimize parasitic inductive effects of an antenna launch probe (e.g., a physical feed line coupled to a radiating element via a solder joint or the like, or a parasitic coupling without physical contact) to give larger bandwidth. In another example, multiple feed ports may be used to drive the same antenna element with inverted phase to cancel out the parasitic current magnitude that contributes to radiated cross-polar power. Reducing the number of feed ports and complexity of the feed network may improve port-to-port isolation. However, it may require specific phasing techniques to ensure that all elements are radiating coherently.

Examples of the present disclosure enhance the impedance bandwidth of the single resonance dipole (or dipole antenna), and also generate an orthogonal current path that allows a vector cancelation of cross-polar power in a dual-polarized antenna element deployment, providing improved radiation pattern performance, port-to-port isolation (e.g., between RF ports feeding orthogonal polarization radiating elements of a dual-polarized antenna element and/or antenna array), and simplified implementation without the complication of multiple feeds.

Figure 3B:
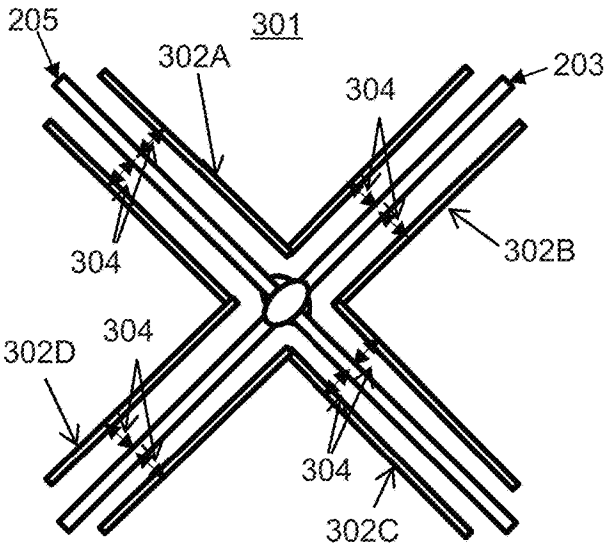
FIGS. 3A-3D illustrate examples of a dual polarized antenna element with "V" shaped parasitic elements, according to the present disclosure.
Figure 3D:
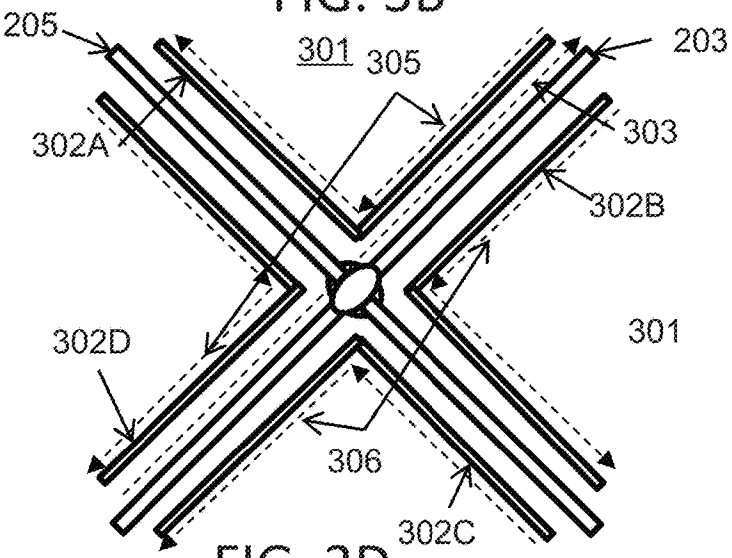
Figure 3A:
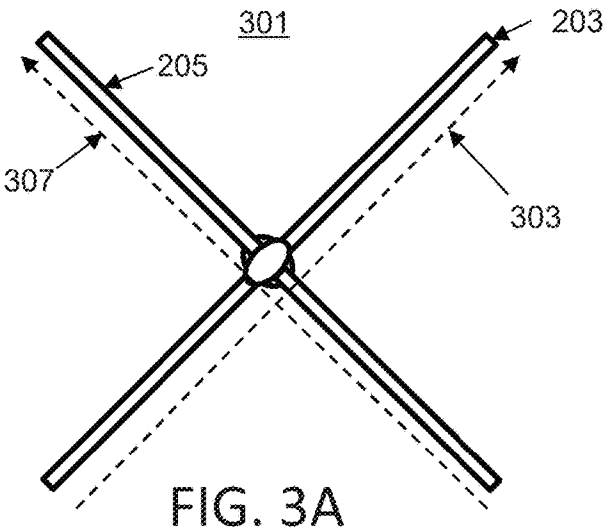

FIG. 3A illustrates an example with a dual-polarized antenna element 301, comprising two orthogonally polarized (and orthogonally oriented) collocated dipoles 203 and 205 (or "radiating elements"), with half wavelength current paths denoted by 303 and 307 respectively. In FIG. 3B four "V" shaped right angled parasitic elements 302A, 302B, 302C, 302D are positioned around the dual-polarized antenna element 301. These parasitic elements 302A, 302B, 302C, 302D are placed at equal distances 304 from the component dipoles 203 and 205. In other words, the parasitic elements 302A, 302B, 302C, 302D are distributed in a symmetrical fashion around the notional center of the dual-polarized antenna element 301.

Figure 3C:
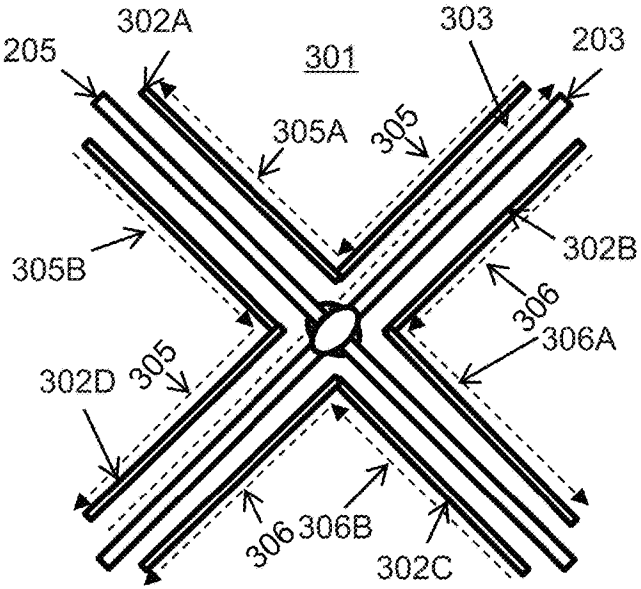

FIG. 3C illustrates the current distribution of the dual-polarized antenna element 301 and demonstrates the additional resonance introduced by the parasitic elements as configured in FIG. 3B. As previously described in connection with FIG. 2A, the dipole 203 resonates at frequency $F_1$ due to the current path 303. From the proximity of parasitic elements 302A and 302D, a current path 305 opposite to the direction of the current path 303 is induced. Similarly, for parasitic elements 302B and 302C, a current path 306 is also induced opposite to the direction of the main current path 303. The electrical length for the current paths of 305 and 306 over the dipole 203 (e.g., a driven dipole/radiating element) generates a second resonance $F_2$ that widens the bandwidth of the dual-polarized antenna element 301. The current paths of 305 and 306 are typically shorter than that of 303 which implies that $F_2$ is typically higher frequency than $F_1$.

FIG. 3D shows the current cancellation effects of the parasitic elements 302A, 302B, 302C, and 302D to improve the port-to-port isolation. Similar to the description of FIG. 3C where dipole 203 is excited with current path 303, the current path 305 on parasitic element 302A also induces a current path 305A due to current continuity on the physical length of parasitic element 302A. Similarly, current path 305 on 302D also induces a current 305B due to current continuity on parasitic element 302D. Note that the current vectors of 305A and 305B are in opposite directions. In the same way, current path 303 also induces a current path 306 on parasitic elements 302B and 302C. Due to the current continuity on the physical lengths of parasitic elements 302B and 302C, the current paths 306A and 306B are also generated. Note that the current vectors of 306A and 306B are also in opposite directions. This implies that current vectors generated from dipole 203 will have minimal coupling into the orthogonal dipole 205 since opposite current vectors 305A, 305B and 306A, 306B are cancelling each other, resulting in no current induced in dipole 205. Dual polarization antenna design using these parasitic current cancellation techniques can improve port-to-port isolation and reduce or eliminate undesirable cross-polar components.

Figure 4A:
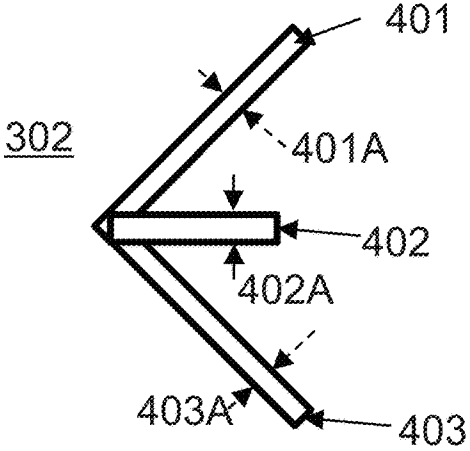
FIGS. 4A-4D illustrate three-branch parasitic elements, and antennas or antenna elements including such three-branch parasitic elements, according to the present disclosure.

FIG. 4A shows the structure of a symmetrical V shaped parasitic element 302 comprising at least two component branches or arms 401 and 403, joined together forming an apex, e.g., at a right angle, or substantially a right angle. A third arm 402 may be present between the two arms to help with the tuning of the dual-polarized antenna element 301 for return loss and isolation parameters. Additionally, the thickness 401A, 402A, and 403A of the arms 401, 402, and 403 can be adjusted to further improve performance.

Figure 4B:
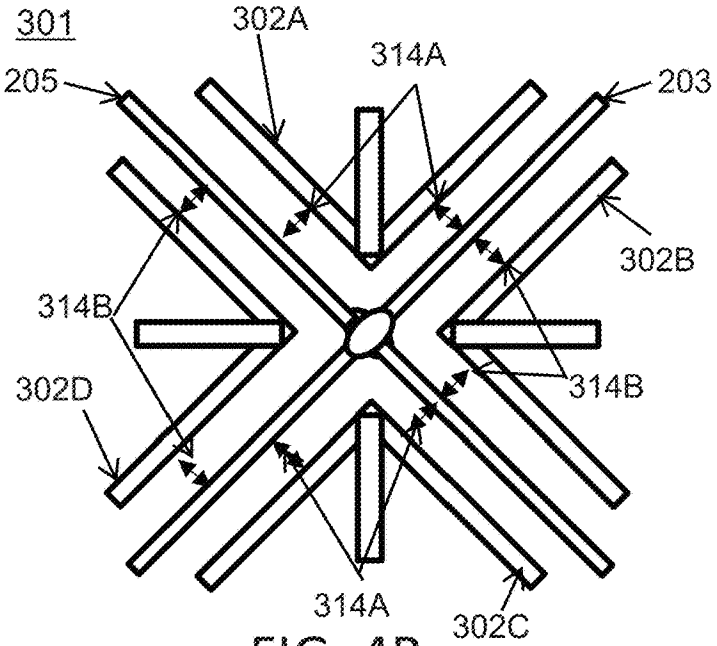

In FIG. 4B the parasitic elements 302A, 302B, 302C, and 302D are distributed around the dual-polarized antenna element 301. The parasitic elements 302A and 302C are spaced away from the dipoles 203 and 205 at a distance of 314A. The parasitic elements 302B and 302D are spaced away from the dipoles 203 and 205 at a distance of 314B. In one example, the distances 314A and 314B may be the same. However, if other antenna elements of the same array or other arrays are in close proximity, a different relationship between distances 314A and 314B may be configured in order to optimize the current cancellation and bandwidth improvement response.

Figure 4C:
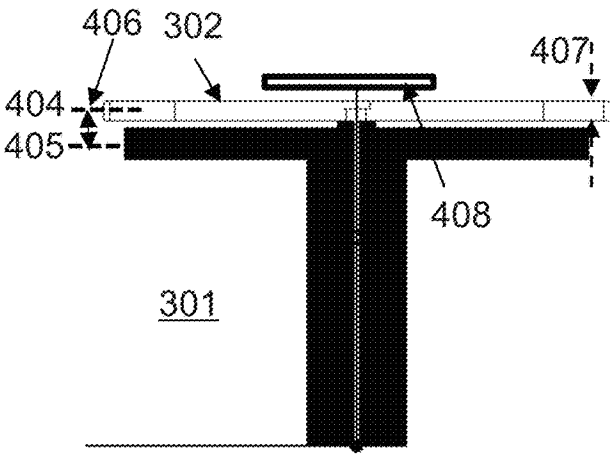
Figure 4D:
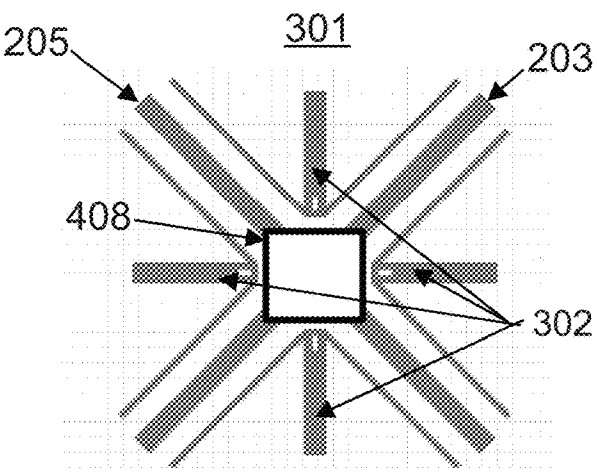

The four parasitic elements 302A, 302B, 302C, 302D as shown in FIG. 4C reside on the horizontal plane denoted by 404. The dipoles 203 and 205 reside on the plane denoted by 405. In one example, the parasitic elements 302A, 302B, 302C, 302D on plane 404 are aligned with the plane 405. However, if other antenna elements of the same array or other arrays are in close proximity, the plane 404 for the parasitic elements 302A, 302B, 302C, 302D and the plane 405 for the dipoles 203 and 205 may be different, resulting in a separation distance 406 in order to obtain optimal current cancellation and bandwidth improvement. Additionally, the thickness 407 of the arms 401, 402, and/or 403 on the parasitic element 302 may be adjusted to further improve coupling with the driven dipoles 203 and 205. For instance, the thickness 407 may be such that the arms 401, 402, and/or 403 partially lie within the plane 405. In one example, the arms 401, 402, and/or 403 may be folded down, stepped down, ramped down, etc., such that arms 401, 402, and/or 403 partially lie within the plane 405. To further improve the matching characteristics, FIG. 4D illustrates that an additional parasitic element 408 (e.g., a patch element) may be included on top of the dipoles 203 and 205.

Figure 5:
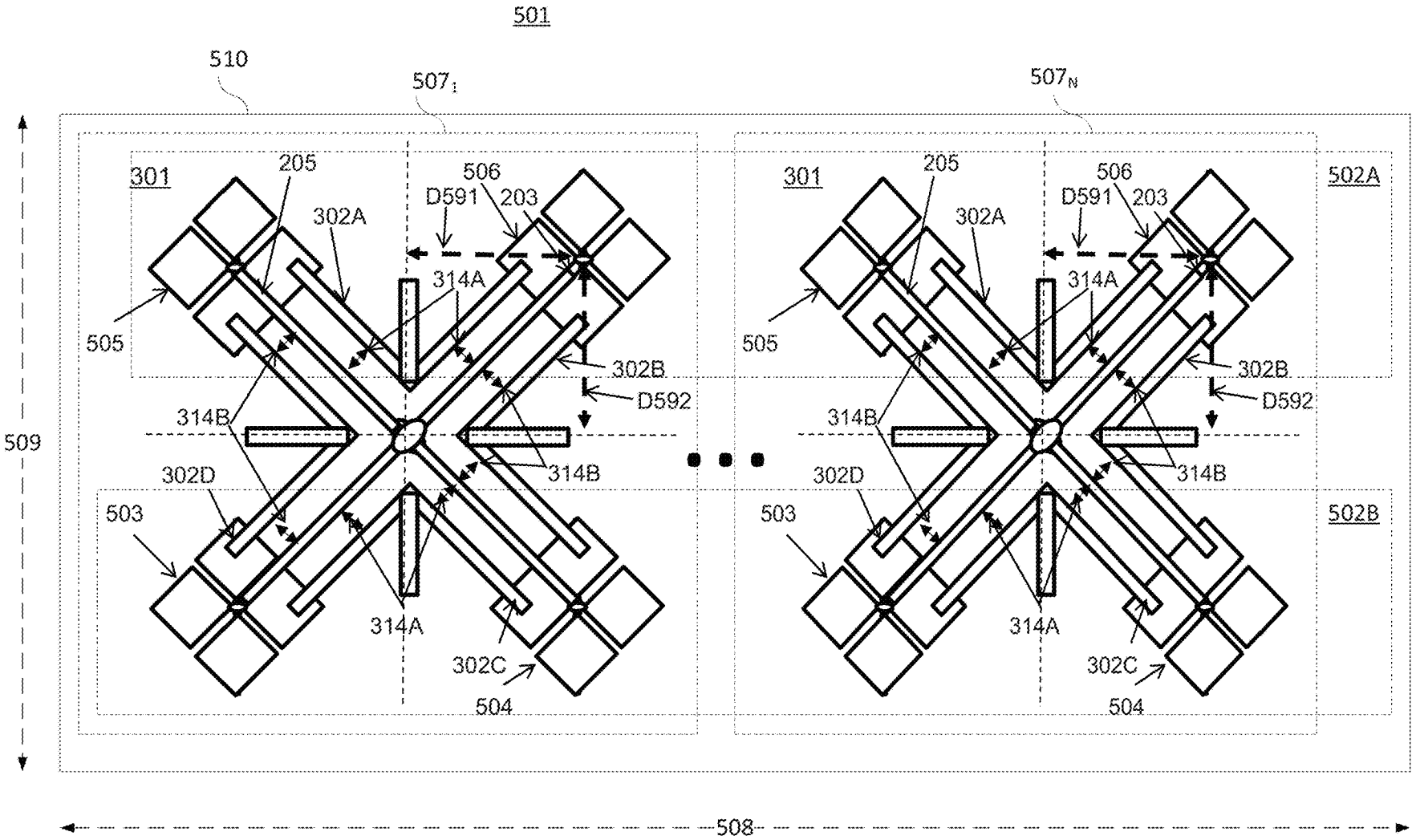
FIG. 5 illustrates an antenna array with dual-polarized antenna elements for operation in a low band (LB) of radio frequency (RF) frequencies integrated with parasitic elements, according to the present disclosure.

FIG. 5 shows an antenna array 501 with dual-polarized antenna elements 301 for operation in a low band (LB) of RF frequencies integrated with parasitic elements 302A, 302B, 302C, 302D and positioned in the center of the antenna reflector 510. In FIG. 5, the top of the antenna array 501 is to the left of the page. Smaller-sized dual-polarized antenna elements designed for operation in a high band (HB) of RF frequencies are positioned around LB dual-polarized antenna elements 301. The antenna elements of the left HB antenna array 502A of FIG. 5 may comprise dual-polarized "bow-tie" elements 503 and 504, while the antenna elements of the right HB antenna array 502B may comprise antenna elements 505 and 506 (also dual-polarized bow-tie elements). This arrangement may be referred to as a side-by-side arrangement of the HB antenna elements within an $i^{th}$ unit cell configuration $507_i$. The first unit cell is referred as $507_1$, where N number of unit cells are implemented in a vertical array along the length 508 of the antenna reflector 510, giving the last unit cell referenced as $507_N$.

The unit cell configuration $507_i$ is a complex RF environment where in-band isolation of the LB and HB dual-polarized antenna elements can be degraded due to mutual coupling of the antenna elements. In one example, isolation may be maximized by arranging the HB dual-polarized antenna elements 503, 504, 505 and 506 at equal distances from a respective LB dual-polarized antenna element 301 as defined by the distance D591 along the length 508 of the reflector 510, and distance D592 along the width 509 of the reflector 510. This implies that distances D591 and D592 are equal, from the center of the LB dual-polarized antenna element 301 to the center of each of the HB dual-polarized antenna elements 503, 504, 505, and 506.

However, in many base station antennas which have a unit cell configuration of one LB and four HB dual-polarized antenna elements as described above, the separation distances D591 and D592 are not equal. In general, when D591 is larger than D592, grating lobes in the elevation radiation plane appear at shallower elevation beam tilt angles. The distance for D592 may be limited to the reflector width size that is available for the HB dual-polarized antenna elements 503, 504, 505, and 506 placed on the left and right side of the LB dual-polarized antenna element 301. The HB dual-polarized antenna elements 503, 504, 505, and 506 may be placed as far away as possible from the LB dual-polarized antenna element 301 to reduce shadowing effects from the larger LB component dipoles and to minimize mutual interactions. Unequal separation distances D591 and D592 may therefore cause an unbalanced RF environment, resulting in less port-to-port isolation and/or cross-polar isolation in the LB dual-polarized antenna element 301. To recover a symmetric RF environment, the parasitic elements 302A, 302B, 302C, 302D shown on the LB dual-polarized antenna element 301 in unit cell $\mathbf{507}_N$ can be adjusted independently to the best position. For example, parasitic elements 302B and 302D can be separated at a distance 314B which is not equal to the separation of the parasitic elements 302A and 302C at a distance of 314A. The imbalanced separation distances of the parasitic elements 302A and/or 302C, and 302B and/or 302D around the LB dual-polarized antenna element 301 may offset the imbalance of the HB dual-polarized antenna element separation distances D591 and D592. This results in improved antenna performance. It should also be noted that in various examples, separation distances 314A and 314C can be also be different, and likewise for D591 and D592.

It should be noted that examples of the present disclosure describe the use of +45/−45 degree slant linear polarizations. However, although linear polarization is typical, and examples are given using linear polarizations, other embodiments of the present disclosure can be readily arrived at, for example including dual-orthogonal elliptical polarization, or left hand circular and right hand circular polarizations, as will be appreciated by those skilled in the art.

While the foregoing describes various examples in accordance with one or more aspects of the present disclosure, other and further example(s) in accordance with the one or more aspects of the present disclosure may be devised without departing from the scope thereof, which is determined by the claim(s) that follow and equivalents thereof.

What is claimed is:

1. An antenna system comprising:

at least one dual-polarized antenna element, the at least one dual-polarized antenna element comprising a first dipole and a second dipole which are in a same lateral plane, the first dipole comprising a first dipole arm and a second dipole arm, the second dipole comprising a third dipole arm and a fourth dipole arm, the first dipole being co-located with the second dipole, and the first dipole having an orthogonal polarization to the second dipole; and a plurality of parasitic elements, each parasitic element comprising at least two branches, the at least two branches including a first branch and a second branch oriented at an angle and forming an apex;

wherein a first branch of a first parasitic element of the plurality of parasitic elements is positioned at a first coupling distance and parallel to the first dipole arm of the first dipole;

wherein a second branch of the first parasitic element is positioned at a second coupling distance and parallel to the third dipole arm of the second dipole;

wherein a first branch of a second parasitic element of the plurality of parasitic elements is positioned at a third coupling distance and parallel to the first dipole arm of the first dipole;

wherein a second branch of the second parasitic element is positioned at a fourth coupling distance and parallel to the fourth dipole arm of the second dipole;

wherein a first branch of a third parasitic element of the plurality of parasitic elements is positioned at a fifth coupling distance and parallel to the fourth dipole arm of the second dipole;

wherein a second branch of the third parasitic element is positioned at a sixth coupling distance and parallel to the second dipole arm of the first dipole;

wherein a first branch of a fourth parasitic element of the plurality of parasitic elements is positioned at a seventh coupling distance and parallel to the second dipole arm of the first dipole; and wherein a second branch of the fourth parasitic element is positioned at an eighth coupling distance and parallel to the third dipole arm of the second dipole.

2. The antenna system of claim 1, wherein the first coupling distance and the second coupling distance are equal.

3. The antenna system of claim 1, wherein the third coupling distance and the fourth coupling distance are equal.

4. The antenna system of claim 3, wherein the first coupling distance, the second coupling distance, the third coupling distance, and the fourth coupling distance are equal.

5. The antenna system of claim 1, wherein the fifth coupling distance and the sixth coupling distance are equal.

6. The antenna system of claim 1, wherein the sixth coupling distance and the seventh coupling distance are equal.

7. The antenna system of claim 1, wherein the fifth coupling distance, the sixth coupling distance, the seventh coupling distance, and the eighth coupling distance are equal.

8. The antenna system of claim 7, wherein the first coupling distance, the second coupling distance, the third coupling distance, the fourth coupling distance, the fifth coupling distance, the sixth coupling distance, the seventh coupling distance, and the eighth coupling distance are equal.

9. The antenna system of claim 1, wherein for each parasitic element of the plurality of parasitic elements, lengths of the at least two branches are equal.

10. The antenna system of claim 9, wherein lengths of the at least two branches of each parasitic element of the plurality of parasitic elements are equal among the plurality of parasitic elements.

11. The antenna system of claim 1, wherein the plurality of parasitic elements lie in the same lateral plane as the first dipole and the second dipole.

12. The antenna system of claim 1, wherein the plurality of parasitic elements lie in a different plane relative to the first dipole and the second dipole.

13. The antenna system of claim 1, wherein a parasitic coupling structure comprising a square patch lies in a plane above an intersection of the first dipole and second dipole.

14. A parasitic element comprising at least two branches, the at least two branches including a first branch and a second branch oriented at an angle and forming an apex, wherein the at least two branches includes a third branch joining at the apex and which is oriented at 45 degrees relative to the first branch and to the second branch of the at least one parasitic element within a same plane;

wherein the parasitic element is for deployment as one of a plurality of parasitic elements for at least one dual-polarized antenna element comprising a first dipole and a second dipole which are in a same lateral plane, the first dipole comprising a first dipole arm and a second dipole arm, the second dipole comprising a third dipole arm and a fourth dipole arm, the first dipole being co-located with the second dipole, and the first dipole being orthogonally polarized to the second dipole;

wherein the first branch of the parasitic element is for positioning at a first coupling distance and parallel to the first dipole arm of the first dipole;

wherein the second branch of the parasitic element is for positioning at a second coupling distance and parallel to the third dipole arm of the second dipole.

15. The parasitic element of claim 14, wherein the first coupling distance and the second coupling distance are equal.

16. The parasitic element of claim 14, wherein lengths of the first branch and the second branch are equal.

17. An antenna system comprising:

at least one dual-polarized antenna element, the at least one dual-polarized antenna element comprising a first dipole and a second dipole which are in a same lateral plane, the first dipole comprising a first dipole arm and a second dipole arm, the second dipole comprising a third dipole arm and a fourth dipole arm, the first dipole being co-located with the second dipole, and the first dipole having an orthogonal polarization to the second dipole; and a plurality of parasitic elements, each parasitic element comprising at least two branches, the at least two branches including a first branch and a second branch oriented at an angle and forming an apex;

wherein a first branch of a first parasitic element of the plurality of parasitic elements is positioned at a first coupling distance and parallel to the first dipole arm of the first dipole;

wherein a second branch of the first parasitic element is positioned at a second coupling distance and parallel to the third dipole arm of the second dipole; and wherein at least one parasitic element of the plurality of parasitic elements has a third branch joining at the apex and which is oriented at 45 degrees relative to the first branch and to the second branch of the at least one parasitic element within a same plane.

18. The antenna system of claim 17, wherein the first coupling distance and the second coupling distance are equal.

19. The antenna system of claim 17, wherein for each parasitic element of the plurality of parasitic elements, lengths of the at least two branches are equal.

20. The antenna system of claim 19, wherein lengths of the at least two branches of each parasitic element of the plurality of parasitic elements are equal among the plurality of parasitic elements.

21. The antenna system of claim 17, wherein the plurality of parasitic elements lie in the same lateral plane as the first dipole and the second dipole.

22. The antenna system of claim 17, wherein the plurality of parasitic elements lie in a different plane relative to the first dipole and the second dipole.

23. The antenna system of claim 17, wherein a parasitic coupling structure comprising a square patch lies in a plane above an intersection of the first dipole and second dipole.

* * * * *